US006425512B2

(12) United States Patent
Hill et al.

(10) Patent No.: US 6,425,512 B2
(45) Date of Patent: Jul. 30, 2002

(54) WEB HANDLING PROCESS

(75) Inventors: Tony Hill; Leif Mohrsen, both of New Westminster (CA)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/877,081

(22) Filed: Jun. 11, 2001

Related U.S. Application Data

(62) Division of application No. 09/373,561, filed on Aug. 13, 1999, now Pat. No. 6,270,629.

(51) Int. Cl.[7] ..... B65H 20/14; G03B 1/56; D21F 11/00

(52) U.S. Cl. ..... 226/7; 226/91; 226/95; 226/97.3; 226/170; 162/202; 162/289

(58) Field of Search ..... 226/7, 91, 95, 226/97.3, 170; 162/202, 289

(56) References Cited

U.S. PATENT DOCUMENTS 1,369,124 A * 2/1921 Pope ..... 226/97.3
3,355,349 A 11/1967 Devlin
3,999,696 A * 12/1976 Reba et al. ..... 226/7
4,014,487 A * 3/1977 Reba et al. ..... 226/7
4,022,366 A 5/1977 Rooney
4,136,808 A * 1/1979 Reba ..... 226/7
4,186,860 A * 2/1980 Reba ..... 226/7
4,342,413 A * 8/1982 Reba ..... 226/7
4,726,502 A * 2/1988 Cryderman ..... 226/97.3
4,904,344 A * 2/1990 Peiffer ..... 226/91
4,923,567 A * 5/1990 Liedes et al. ..... 226/7
6,073,825 A * 6/2000 Hilker ..... 226/7
6,270,629 B1 * 8/2001 Hill et al. ..... 226/91

FOREIGN PATENT DOCUMENTS

DE 91093139 11/1991

* cited by examiner

*Primary Examiner*—Michael R. Mansen
(74) *Attorney, Agent, or Firm*—Greenblum & Bernstein, P.L.C.

(57) ABSTRACT

A process of transporting at least a portion of a web from a first structure to a second structure via an apparatus that includes at least two pulleys located at spaced locations from each other, an air-pervious endless belt positioned to run from the first structure to the second structure, an underpressure source arranged to produce an underpressure adjacent to the run of the endless belt, a nose shoe disposed beyond the second pulley and spaced from the second pulley, thereby defining an opening. The nose shoe has an inlet and air jet outlet positioned adjacent the second pulley. A guiding tray is arranged beyond the nose shoe having an upstream section positioned adjacent the nose shoe, and the upstream section includes an air slot, which extends crosswise to a web travel direction. The process includes transferring the at least a portion of the web from the first structure onto the endless belt, holding the at least a portion of the web onto the endless belt through the underpressure, directing air from the air jet outlet through the opening in a direction against a rotational direction of the second pulley, transferring the at least a portion of the web from the endless belt to the nose shoe, and directing an air curtain from the upstream section of guiding tray along a surface of the guiding tray, whereby the at least a portion of the web is guided over the guiding tray.

6 Claims, 1 Drawing Sheet

WEB HANDLING PROCESS

CROSS REFERENCE TO RELATED APPLICATIONS

The present application is a divisional application of U.S. Pat. Application Ser. No. 09/373,561 filed Aug. 13, 1999, now U.S. Pat. No. 6,270,629 B1 which issued on Aug. 7, 2001, the disclosure of which is expressly incorporated by reference herein in its entirety.

BACKGROUND OF THE INVENTION

1. Field of Invention

This invention relates to an apparatus for transporting a web of a flexible material between a first and a second position. In particular, and in a preferred embodiment, the invention provides an apparatus, known as a "vacuum conveyor", for transporting a web, preferably a lead strip of a paper web from the dryer of a paper-making machine to the first nip of a calender of the machine or to a winding machine or between any other sections of a paper-making or paper-finishing (e.g. coating) machine.

The present invention is intended as an improvement over the operation of the apparatuses described in U.S. Pat. Nos. 3,355,349 and 4,022,366. All features disclosed in these patents are incorporated into the present patent application by reference.

2. Discussion of Background Information

U.S. Pat. No. 3,355,349 issued on Nov. 28, 1967 describes an apparatus for transporting a lead strip of paper web from the dryer of a paper-making machine and feeding into the first roll nip of the calender of said machine. The apparatus comprises an elongated frame, an air-pervious (air permeable) endless belt movably mounted an the frame and having one run, e.g. its upper run travelling from the dryer to the first roll nip of the calender. The belt is arranged to receive the lead strip from the dryer. A vacuum chest having a perforated top extends longitudinally of and below the upper run of the belt. There are device for evacuating air from the chest so as to apply the lead strip to cling to the belt. Air blast means beneath, and extending transversely of, the upper run of the belt are positioned at the discharge end. These air blast device direct a blast of air upwardly through the belt to lift the lead strip from the belt and extend the lead strip towards the first roll nip of the calender. Thus, the apparatus described in the above United States Patent is provided with device for ensuring that the lead strip is temporarily attached to the belt and with device to ensure that the lead strip can leave the belt at the appropriate time.

U.S. Pat. No. 4,022,366 issued on May 10, 1977 provides an improvement to the apparatus of the above U.S. Pat. No. 3,355,349. Said improvement comprises an opening where the web or lead strip leaves the belt and an air jet device able to direct air through the opening in a direction contrary to the direction of movement of the belt and with a strength sufficient both to overcome any gripping effect of air entrained within the air-pervious belt and to lift the web of flexible material.

In a preferred embodiment, the above apparatus has a discharge shoe or "nose shoe" disposed beyond the second pulley and spaced slightly from the second pulley to define an opening between the shoe and the second pulley. Provided is an inlet into the shoe to receive a supply of air, a plurality of outlets disposed in the nose shoe adjacent the second pulley whereby an air jet may be directed through the opening and against the web in a direction contrary to the rotation of the second pulley.

The above apparatus has been found to be effective with paper of the heavier basis weights. The system is able to project such paper forward and, by varying the air flow, may control the angle of trajectory in relation to the belt face. However, lightweight tissues still give problems. Lightweight tissue has been found to fall over the end of the shoe out of control. Accordingly, in a further improvement, the apparatus of U.S. Pat. No. 4,022,366 includes a second air jet device, downstream from the first air jet (that is the device able to direct air through the opening); the second air jet device is able to direct air downstream to act as a platform for the web. The second air jet device is preferably provided with holes that are small in diameter to give a velocity flow with minimum air volume. The tissue web will not fall through this air stream until the stream is too weak to provide support.

The improved apparatus works well in most circumstances but it has been found that as the velocity of the paper-making or paper-finishing machines is increased up to more than 2000 meters per minute, it becomes more and more difficult to properly project the web or lead strip from the downstream end of the apparatus to the following structure or to the following section of the machine. The reason for that problem is that the web or lead strip tends to twist so that it cannot enter in a straight line into the following structure of section, e.g. into the first nip of a calender. The present invention seeks to avoid this disadvantage and to provide a further improvement to the apparatus described above.

SUMMARY OF THE INVENTION

According to the present invention the apparatus has again a discharge shoe or a "nose shoe" beyond the second pulley wherein a plurality of outlets are disposed adjacent the second pulley. Air jets may be directed through the outlets against the web or lead strip in a direction contrary to the travelling belt. In addition to that nose shoe, guiding tray, e.g., in the form of a metal plate, is arranged immediately beyond the nose shoe to extend along the web path. In the upstream section of the guiding tray, an air slot is provided which extends across the web path. This air slot is adapted to emit an air jet or air curtain, first approximately perpendicular to the guiding tray. However, this air jet is immediately turned—by the known Coada effect—into a direction approximately paralled to the guiding tray. For this purpose, the air slot is connected to the guiding tray by a rounded edge. The Coada effect is also used to entrain the tail of the paper web or lead strip in a very controlled manner in the direction of the guiding tray as the tail leaves the nose shoe.

Preferably, the guiding tray may be pivoted around an axis which is arranged across the web travel direction. This axis may be close to the rounded edge. Thereby, the guiding tray may be angularly adjusted for targeting of the entrained tail at multiple selectable discharge angles. In summary, the invention provides a new design which is effective at all transfer speeds. But it provides a significant improvement over the prior art, particularly at extremely high paper transfer speeds, e.g. between 2000 and 3000 meters per minute.

A further improvement may be achieved by a second air slot arranged at the downstream end of the guiding tray, e.g. between the metal plate and an auxiliary plate arranged parallel to the metal plate, e.g., similar to German Utility Model G 91 09 313.9. The auxiliary plate may extend beyond the downstream end of the guiding tray and can be effective as a prolongation of the guiding tray.

The present invention is directed to an apparatus for transporting at least a portion of a web of flexible material between first and second structures spaced from each other. The apparatus includes an at least two pulleys located at spaced locations from each other, and an air-pervious endless belt movably mounted on the first and second pulleys. The belt has a run traveling from the first pulley, adjacent the first structure, to the second pulley, adjacent the second structure, and the belt is adapted and arranged to receive the at least a portion of the web from the first structure. An underpressure source is arranged to produce an underpressure adjacent to the run of the endless belt. A nose shoe is disposed beyond the second pulley and spaced from the second pulley, so as to define an opening between the nose shoe and the second pulley at a position where the at least a portion of the web leaves the endless belt. The nose shoe includes an inlet adapted to receive a supply of air, and air jet outlet positioned adjacent the second pulley, and the air jet outlet is adapted to direct at least one air jet into the opening in a direction contrary to a rotation of the second pulley, such that the at least one air jet is sufficient to lift the at least a portion of the web from the endless belt. A guiding tray is arranged beyond the nose shoe having an upstream section positioned adjacent the nose shoe, and the upstream section includes an air slot, which extends cross-wise to a web travel direction, adapted for emitting an air curtain that flows along the surface of the guiding tray.

According to a feature of the invention, an air flow direction through the air slot can be approximately perpendicular to the guiding tray. Further, the upstream section of the guiding tray can have a rounded edge, such that the air flow emitted from the air slot may be turned by the rounded edge into a direction approximately parallel to the guiding tray. The rounded edge may include a pipe which forms an air feeding conduit to the air slot.

In accordance with another feature of the present invention, the guiding tray may be pivotable around an axis extending cross-wise to the web travel direction in an area of the upstream section. The axis can be an axis of the pipe.

According to still another feature of the instant invention, the guiding tray may further include a downstream end that includes a second air slot.

Further, the nose shoe can include an air jet opening positioned upstream from the opening.

The apparatus may also include an air pipe having perforations adapted to direct air in a direction one of perpendicular to and obliquely to the web run direction. The air from the air pipe can be directed obliquely, and in a same direction as the web run direction.

Still further, the underpressure source can include a vacuum chest having a perforated wall positioned adjacent the run of the endless belt. A vacuum supply device can be adapted to evacuate air from the chest so that a vacuum is applied to suction the at least a portion of the web onto the endless belt. Moreover, the vacuum chest may longitudinally extend in the web run direction. Further still, the at least a portion of the web can include a lead strip of the web. The two pulleys can be coupled to the vacuum chest.

An elongated frame can be provided, and the two pulleys can be coupled to each end of the elongated frame.

Further still, the underpressure source can include a plurality of air jet device arranged so that the underpressure holds the web onto the endless belt.

The present invention is also directed to a process of transporting at least a portion of a web from a first structure to a second structure via an apparatus. The apparatus can include at least two pulleys located at spaced locations from each other, an air-pervious endless belt positioned to run from the first structure to the second structure, an underpressure source arranged to produce an underpressure adjacent to the run of the endless belt, a nose shoe disposed beyond the second pulley and spaced from the second pulley, to define an opening, the nose shoe having an inlet and air jet outlet positioned adjacent the second pulley, a guiding tray arranged beyond the nose shoe having an upstream section positioned adjacent the nose shoe, and the upstream section including an air slot, which extends cross-wise to a web travel direction. The process includes transferring the at least a portion of the web from the first structure onto the endless belt, holding the at least a portion of the web onto the endless belt through the underpressure, directing air from the air jet outlet through the opening in a direction against a rotational direction of the second pulley, transferring the at least a portion of the web from the endless belt to the nose shoe, and directing an air curtain from the upstream section of guiding tray along a surface of the guiding tray, such that the at least a portion of the web is guided over the guiding tray.

In accordance with a feature of the present invention, the process can further include directing air jets through the endless belt in a region of second pulley. Further, the process can include blowing air along a surface of the guiding tray opposite the surface adapted to guide the at least a portion of the web.

According to another feature of the instant invention, the at least a portion of the web can include a lead strip of the web.

In accordance with still another feature of the invention, the underpressure source can include a vacuum chest having a perforated wall positioned adjacent the run of the endless web and a vacuum supply device, and the holding of the at least a portion of the web onto the endless belt may include suctioning the at least a portion of the web onto the endless belt through the suction chest.

In accordance with still yet another feature of the instant invention, the underpressure source can include a plurality of air jet devices, and the holding of the at least a portion of the web onto the endless belt may include holding the web onto the endless belt through an underpressure produced by the plurality of air jet devices.

BRIEF DESCRIPTION OF THE DRAWINGS

The attached drawing illustrates the invention, by way of example.

DESCRIPTION OF PREFERRED EMBODIMENT

Figure 1:
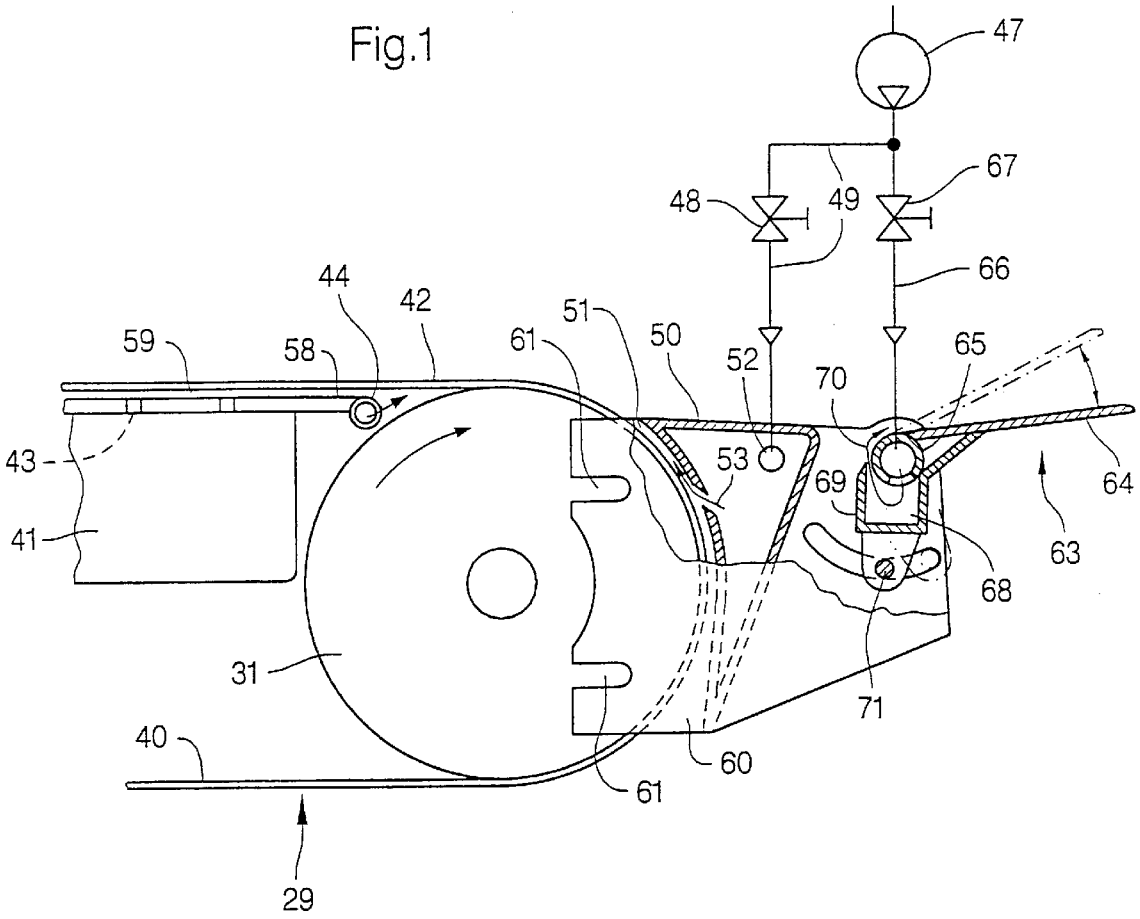
FIG. 1 shows the downstream section of a vacuum conveyor, partly in a side view, partly in a longitudinal section.

The conveyor designed according to the present invention comprises an endless belt 29 that extends between a pair of belt pulleys, namely a first (upstream) pulley, not shown and a second (downstream) pulley 31. Belt tensioners are provided which are of known construction and are not therefor described here. The side frames are connected to the vertical sides of an enlongated chest 41. Chest 41 is located between the lower run 40 of the belt 29 and its upper run 42. Chest 41 extends longitudinally of the conveyor belt 29 between the pulleys. The chest has a perforated wall located adjacent to and parallel to one of said belt runs. With the illustrated design, the perforated wall is adjacent to the upper run 42 of the belt. An opposite design may also be provided. The perforations may take any desired form, for example, holes 43. The chest 41 is also provided with a conduit which is connected by suitable air line to a vacuum pump.

Beyond the second pulley 31, a "nose shoe" or discharge shoe 50 is positioned. This shoe 50 is spaced from the pulley 31 to define an opening 51. This shoe functions as a shaped air receiver to give maximum affect to air flow through jets 53 which make up a first air jet. The shoe 50 is provided with an inlet 52 that is connected via line 49 and control valve 48 to a source 47 of compressed air. The shoe is provided with angled outlets 53 able to direct air through the opening 51 between the second pulley 31 and the shoe 50. The air is specifically directed in a direction contrary to the direction of movement of the belt 29, that is contrary to the direction of rotation of the pulley 31.

The shoe 50 is provided with two brackets 60 formed with openings 61 so that it may be mounted on the apparatus. Downstream of shoe 50, the brackets 60 support a guiding tray 63 which comprises a metal plate 64 and a pipe 65 connected to plate 64 at its upstream end. Pipe 65 is pivotally supported in bearings (not shown) connected to brackets 60. The interior of pipe 65 is connected via line 66 and control valve 67 to said source 47 of compressed air. An air flow is induced from pipe 65 through openings into a chamber 68. A wall 69 of this chamber 68 forms together with pipe 65 an air slot which extends across the web path. An air jet 70 is emitted by the air slot and is turned via the rounded external surface of pipe 65—due to the Coada effect—into a direction parallel to plate 64. The guiding tray 63 may be fixed, in a selectable angular position, to the brackets 60, e.g., a bolt 71. Extending transversely across the conveyor and located beneath the belt 29 and between the chest 41 and the pulley 31, there may be arranged a perforated pipe 44 which is connected by suitable conduits (not shown) to said air source 47. The perforations in the pipe are arranged so that when air pressure is applied to the pipe the air blast issuing from the perforation will be directed in a direction upwardly against the underside of the belt 29 and forwardly through the same. This may, In some cases (dependent from the paper grade or transfer speed) help to lift the tail of the web or lead strip from the belt 29. However, it is expected that in many cases, pipe 44 may be dispensed with, so that air streams 53 are the sole manner of lifting the tail from belt 29. In other cases, where pipe 44 is present, it may be possible that air streams 53 are dispensed with.

Figure 2:
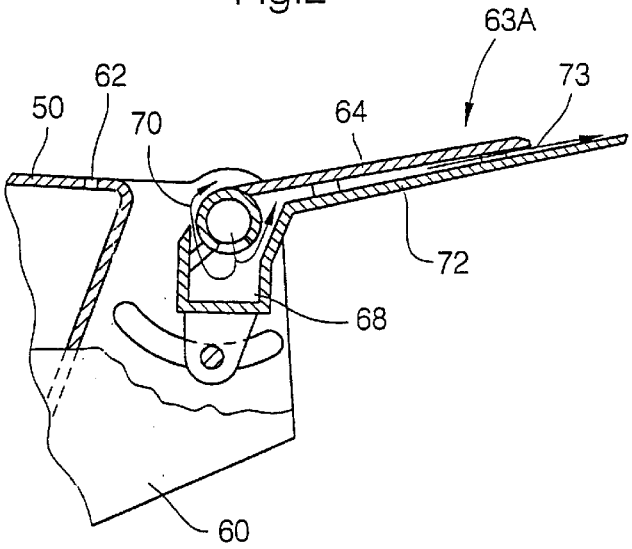
FIG. 2 shows a modification of the conveyor shown in FIG. 1.

The modified apparatus shown in FIG. 2 comprises a guiding tray 63A which has—in addition to plate 64—an auxiliary plate 72 connected to the walls of chamber 68 and extending preferably beyond the downstream and of plate 64. Both plates 64 and 72 form a second air slot 73.

A feature of the invention that can be particularly useful if there is a possibility of static electricity causing the paper to tend to cling to the shoe 50 is the provision of small outlets 62 in the upper surface of the shoe 50. The holes 62 may direct air at an angle to the surface or normal to the surface to overcome any tendency of certain types of paper being attracted to the surface by electrostatic charge.

The device of the present invention can be used wherever it is desired to move a web of flexible material, particularly paper, across a gap. The invention is of particular importance where it is required to project a paper tail across an open space and send it to a position where the tail can be picked up and fed to the following machine section, e.g. a reel.

What is claimed:

1. A process of transporting at least a portion of a web from a first structure to a second structure via an apparatus that includes at least two pulleys located at spaced locations from each other, an air-pervious endless belt positioned to run from the first structure to the second structure, an underpressure source arranged to produce an underpressure adjacent to the run of the endless belt, a nose shoe disposed beyond the second pulley and spaced from the second pulley, thereby defining an opening, the nose shoe having an inlet and air jet outlet positioned adjacent the second pulley, a guiding tray arranged beyond the nose shoe having an upstream section positioned adjacent said nose shoe, and the upstream section including an air slot, which extends crosswise to a web travel direction, said process comprising:

transferring the at least a portion of the web from the first structure onto the endless belt;

holding the at least a portion of the web onto the endless belt through the underpressure;

directing air from the air jet outlet through the opening in a direction against a rotational direction of the second pulley;

transferring the at least a portion of the web from the endless belt to the nose shoe; and directing an air curtain from the upstream section of guiding tray along a surface of the guiding tray, whereby the at least a portion of the web is guided over the guiding tray.

2. The process in accordance with claim 1, wherein the underpressure source comprises a vacuum chest having a perforated wall positioned adjacent the run of the endless web and a vacuum supply device, and the holding of the at least a portion of the web onto the endless belt comprises suctioning the at least a portion of the web onto the endless through the suction chest.

3. The process in accordance with claim 1, wherein the underpressure source comprises a plurality of air jet devices, and the holding of the at least a portion of the web onto the endless belt comprises holding the web onto the endless belt through an underpressure produced by the plurality of air jet devices.

4. The process in accordance with claim 1, further comprising:

directing air jets through the endless belt in a region of second pulley.

5. The process in accordance with claim 4, further comprising:

blowing air along a surface of the guiding tray that is opposite the surface of the guiding tray adapted to guide the at least a portion of the web.

6. The process in accordance with claim 1, wherein the at least a portion of the web includes a lead strip of the web.

* * * * *